US009240263B2

(12) United States Patent
Kim et al.

(10) Patent No.: US 9,240,263 B2
(45) Date of Patent: Jan. 19, 2016

(54) DEVICE CONNECTION CABLE WITH FLAT PROFILE

(71) Applicant: Google Inc., Mountain View, CA (US)

(72) Inventors: Eliot Kim, Cupertino, CA (US); Russell Norman Mirov, Los Altos, CA (US)

(73) Assignee: Google Inc., Mountain View, CA (US)

( * ) Notice: Subject to any disclaimer, the term of this patent is extended or adjusted under 35 U.S.C. 154(b) by 202 days.

(21) Appl. No.: 13/930,982

(22) Filed: Jun. 28, 2013

(65) Prior Publication Data

US 2015/0000953 A1 Jan. 1, 2015

(51) Int. Cl.

| | |
|---|---|
| ***H01B 13/24*** | (2006.01) |
| ***H01B 11/20*** | (2006.01) |
| *H01B 7/04* | (2006.01) |

(52) U.S. Cl.

CPC ..... *H01B 13/24* (2013.01); *H01B 11/203* (2013.01); *H01B 7/04* (2013.01); *Y10T 29/49227* (2015.01)

(58) Field of Classification Search

CPC ..... H01B 1/00; H01B 3/00; H01B 7/00
USPC .... 174/110 R–110 PM, 113 R, 117 R, 117 F, 174/117 FF, 120 R, 120 SC, 121 R
See application file for complete search history.

(56) References Cited

U.S. PATENT DOCUMENTS

| | | | | |
|---|---|---|---|---|
| 4,609,416 | A | 9/1986 | Himmelberger et al. | |
| 6,030,571 | A | 2/2000 | Nakane et al. | |
| 6,399,885 | B1 | 6/2002 | Agostinelli | |
| 6,844,500 | B2 | 1/2005 | Williams et al. | |
| 7,601,425 | B2 * | 10/2009 | Stoffer et al. | 428/418 |
| 7,612,290 | B1 * | 11/2009 | Le | 174/117 F |
| 7,989,701 | B2 | 8/2011 | Kosaka et al. | |
| 2003/0132022 | A1 | 7/2003 | Williams et al. | |
| 2004/0026114 | A1 * | 2/2004 | Hsieh | H01B 7/0861 174/117 F |
| 2010/0321591 | A1 | 12/2010 | Onomatsu | |
| 2011/0174515 | A1 | 7/2011 | Siahaan et al. | |
| 2013/0068523 | A1 | 3/2013 | Sato et al. | |
| 2013/0076833 | A1 | 3/2013 | Honglin | |

FOREIGN PATENT DOCUMENTS

| | | | |
|---|---|---|---|
| WO | 2006132881 | A1 | 12/2006 |

OTHER PUBLICATIONS

International Search Report and Written Opinion for Application No. PCT/US2014/044061 dated Oct. 8, 2014.

* cited by examiner

*Primary Examiner* — William H Mayo, III
(74) *Attorney, Agent, or Firm* — Lerner, David, Littenberg, Krumholz & Mentlik, LLP

(57) ABSTRACT

A cable includes a flexible jacket extending along a length and first and second lateral axes perpendicular to the length. The jacket also defines flat major surfaces that are parallel to each other and spaced apart on opposite sides of the first lateral axis. First and second inner wire assemblies extend within the jacket. The jacket maintains the first and second inner wire assembles in predetermined positions along the first lateral axis within 0.05 mm of each other and disposed on opposing sides of the second lateral axis. First and second outer wire assemblies also extend within the jacket. The outer wire assemblies include a wire of conductive filaments and an insulating layer of an enamel material surrounding the wire. The jacket maintains the first and second outer wire assemblies in positions along the first lateral axis and spaced apart from the first and second inner wire assemblies.

20 Claims, 3 Drawing Sheets

DEVICE CONNECTION CABLE WITH FLAT PROFILE

BACKGROUND

Various forms of cables are used to carry signals to and provide power for portable electronic devices. In many arrangements cables can be used to connect a device to a wall outlet to provide power either for direct operation or to charge an internal batter for later usage. In other arrangements, cables can be used to facilitate connections between portable electronics, such as between smartphones and computers, from one computer to another computer, or from a computer to another peripheral device. Such cables often involve various forms of mating connections, wherein for example, the cable has ends that are configured according to a standard or proprietary configuration, both in shape and with respect to a number and position of electrical connections therein. Such an end can mate with a properly configured port in, for example a computer. The other end of the cable can have the same or a different connection that corresponds with a port in, for example, a portable electronic device.

Many computers and computer peripheral connections are configured to provide power to a portable electronic device, including designated connections that connect, through corresponding wires in the cable to corresponding power pins in a device. In such arrangements, power adapters can also be provided that can connect with a wall outlet and convert the outlet power to that which the power pins and wires are adapted to carry. A common cable can provide power and a signal connection with a computer, directly, or a power source, through connection with an adapter.

In other cable configurations, a jacket can be a thin-walled outer structure that surrounds an insulating material that itself surrounds and maintains position of individual wires.

BRIEF SUMMARY

The present disclosure describes a connection cable having a flexible body extending along a length thereof. The body has a generally flat profile in a cross section perpendicular to the length that includes parallel flat major surfaces that can define portions of a rectangular cross section. In some embodiments, the cable can include rigid connection features on opposite ends of the body.

In an aspect of the present disclosure, the connection cable includes a generally flexible jacket that extends along a length thereof and along first and second lateral axes that are perpendicular to the length. The jacket also defines substantially flat first and second major surfaces that are generally parallel to each other and are spaced apart opposite sides of the first lateral axis. First and second inner wire assemblies extend within the jacket. Each of the inner wire assemblies includes a wire comprised of a plurality of conductive filaments, a shielding layer surrounding the wire, and an outer insulating layer surrounding the shielding layer and spaced apart from the wire. The jacket maintains the first and second inner wire assembles in predetermined positions along the first lateral axis within 0.05 mm of each other and disposed on opposing sides of the second lateral axis. First and second outer wire assemblies also extend within the jacket. Each of the outer wire assemblies include a wire comprised of a plurality of conductive filaments and an insulating layer consisting essentially of an enamel material surrounding the wire. The jacket maintains the first and second outer wire assemblies in predetermined positions along the first lateral axis and spaced apart from the first and second inner wire assemblies on respective opposite sides of the second lateral axis.

Another aspect of the present disclosure relates to a method for making a connection cable. The method includes applying a compressive force to a plurality of wires in a first radial direction over a length of the wires to temporarily reduce a dimension of each of the wires in the first radial direction. The method also includes forming a jacket over the plurality of wires that contains the wires in a unitary structure. The jacket is formed to define a major surface that is substantially flat in a second direction perpendicular to the first radial direction and extends along a length of the cable and such that the wires are maintained in predetermined positions within the jacket such that they are aligned in the second direction.

Another aspect of the present disclosure relates to a connection cable. The connection cable includes a generally flexible jacket extending along a length thereof and along first and second lateral axes perpendicular to the length. The cable also includes first and second power wire assemblies extending within the jacket. Each of the power wire assemblies includes a wire comprised of a plurality of conductive filaments and an insulating layer consisting essentially of an enamel material surrounding the wire and filling spaces between some of the conductive filaments thereof. The jacket maintains the first and second power wire assemblies in predetermined positions along the first lateral axis.

DETAILED DESCRIPTION

Figure 1:
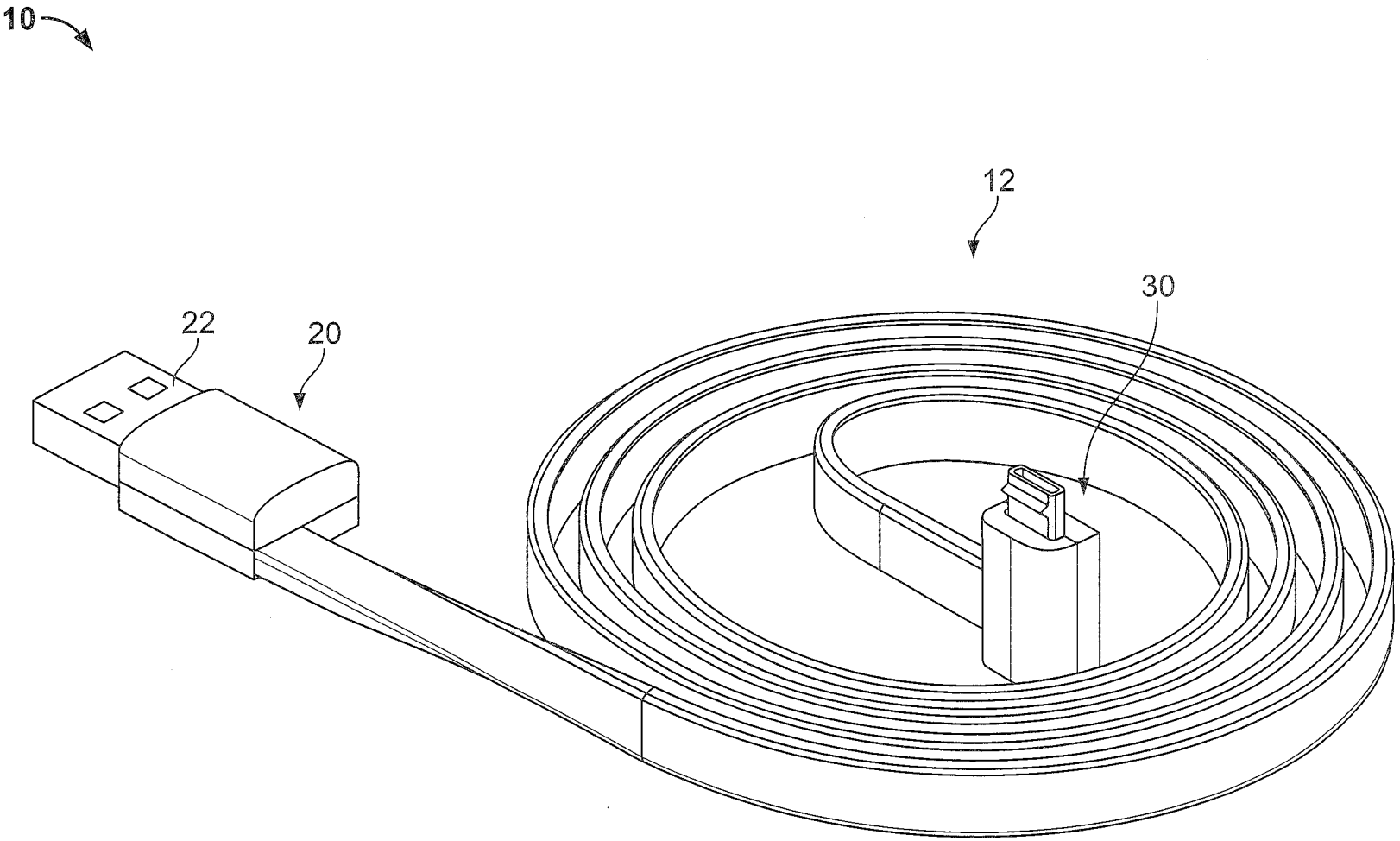
FIG. 1 shows a connection cable according to an aspect of the present disclosure.

Turning to the Figures, where similar reference numerals are used to represent similar features (unless otherwise noted), FIG. 1 shows a cable assembly 10 according to an embodiment of the disclosure. Cable 10 is shown as an assembly having a cable body 12 with ends 20 and 30 thereof that are configured to provide connections between cable 10 and another electronic device, power source, or the like. Cable body 12 can include a number of individual wires (such as signal wires 40 and power wires 60, discussed further below) internal to a flexible wire jacket 70 (FIG. 2) that provides support and additional insulation for the internal wires. Any number of wires can be included in cable body 12, and generally, the number of such wires can correspond to the number of connections between devices that the cable 10 is configured to provide. In an example, cable 10 can be used to connect an electronic device with a computer. Such electronic devices can include, among others, a smartphone, a tablet computer, an external memory device or the like. In such an example, cable 10 can be used to carry information back and forth between the computer and the device, to provide power to the device, or a combination of both. Cable body 12 can be configured to have any length (which can be measured, for example, by the distance between ends 20 and 30 when the cable assembly is laid flat with the cable body 12 extending in a generally straight line) desired to facilitate connection between electronic devices. In an example, different cables 10 can be provided in varying length, such as 0.5 m, 1.5 m, or 3 m.

To allow for connection between electronic devices, as in the above examples, cable 10 is configured with ends 20 and 30 that are structured to connect with mating ports in electronic devices or components by insertion thereinto. In the example of FIG. 1, first end 20 includes a connection 22 that is in the form of a standard USB-A style connection. Connection 22 is attached to and extends from a housing 24 that covers the joints between various features of connection 22 and the wires (not shown in FIG. 1) that extend through cable body 12. Housing 24 can also provide a rigid feature that a user can grasp while inserting or removing connection into or out of a mating USB port. In other examples, connection 22 can be configured to connect with a Firewire™ port or any other standardized, proprietary, or specialized connection port in a computer or other electronic device. In the example shown in FIG. 1, the first end 20 with the USB-A style connection structure 22 can, in addition to connecting with a USB port of a computer, connect with a USB power connection in, for example a power adapter (not shown) that can connect with a wall outlet. This allows the same cable 10 to connect with a computer, for charging a device or data transfer between a device and a computer, or to an adapter to charge a device. Other connections can be used to connect with an adapter, including other computer peripheral connections configured for delivering power, a barrel-type connection, or other proprietary or specialized connections, As also shown in FIG. 1, second end 30 includes a connection structure 32 and a housing 34 that conceals any internal joints between conductive features of the connection structure 32 and the wires internal to the cable body 12. Connection structure 32 can be arranged to connect with an electronic device, which can include by an arrangement that is similar to connection structure 22 of first end 20. In other embodiments, such as that shown in FIG. 1, the connection structure 32 of second end 30 can be generally smaller than that of first end 20 to connect with the generally smaller connection ports of portable electronic devices, such as smartphones, head-mounted displays, or the like. In an embodiment, connection structure 32 can be a USB-B or a USB-mini size connection structure, a 4-pin Firewire™ connection structure or the like. In a further embodiment, connection structure 32 can be a specialized or proprietary structure configured to connect with a mating port in a device. Such structures can be used to provide variations of cable 10 that can have a similar connection structure 32 on second end 30 but different connection structures 22 on first end 20. Although connection structure 32 is shown projecting at a 90° angle to the length of cable body 12, other examples are possible wherein connection structure 32 is in line with cable body 12 or at another angle thereto. Still further, a similar cable body 12 can be included in an alternative assembly that can be used to carry signals only (such as in an audio connection or headphone cable) or power only (such as in a power cable or adapter assembly), with appropriately-configured connection ends for either implementation.

Figure 2:
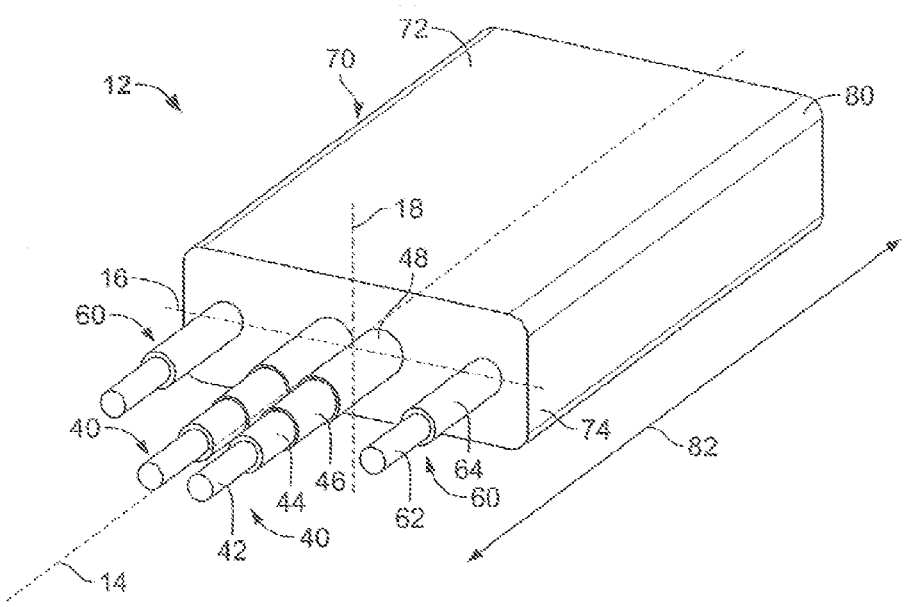
FIG. 2 shows a cutaway perspective view of components internal to a cable body of the connection cable shown in FIG. 1.
Figure 3:
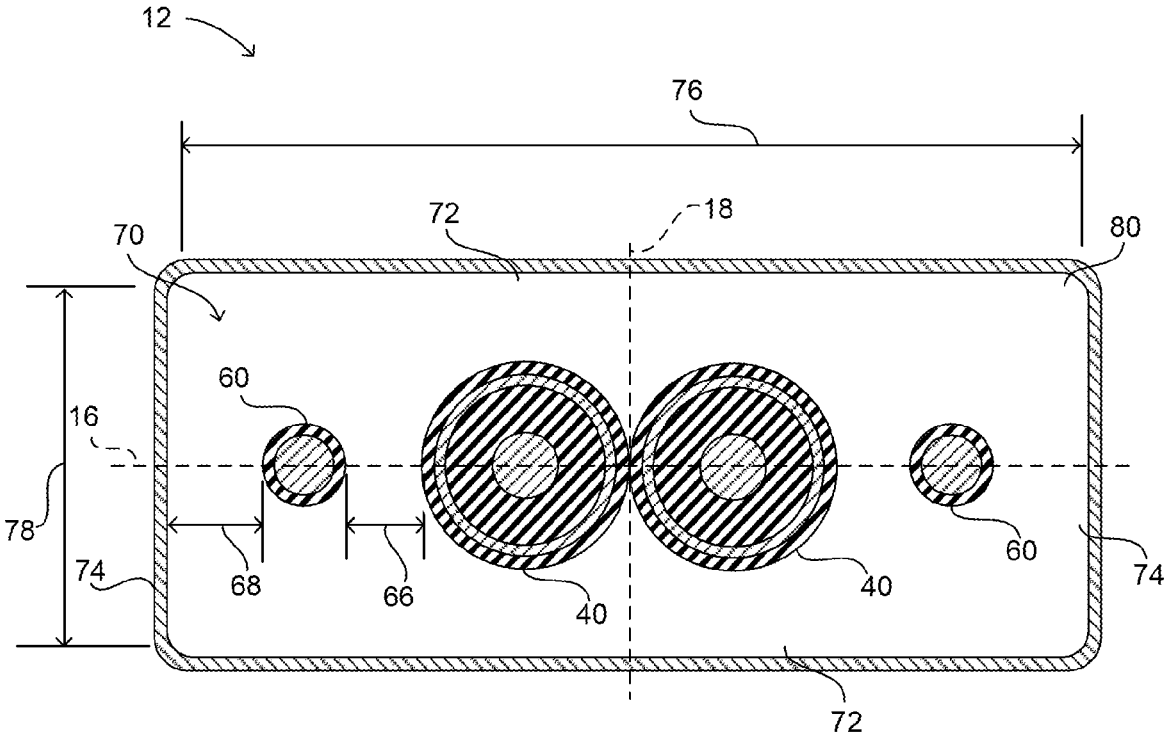
FIG. 3 shows a cross-sectional view of the cable body of FIG. 2.

As can be seen in FIG. 1, the outer shape of cable body 12 can be generally rectangular in cross-section. The particular embodiment of cable body 12 shown in the figures is elongated in one lateral direction compared to another lateral direction such that the rectangular cross-section gives the appearance of a generally "flat" cable. Such cables can be advantageous because of their resistance to undesirable twisting, knotting, and/or tangling. Flat cables can also be generally regarded as easier to gather or wind for storage when not in use. Further, flat cables are resistant to kinking (or retaining bends therein) in a direction along a plane parallel to the wider of the two lateral directions. As shown in FIGS. 2 and 3, the outer shape of cable body 12 is defined by the outside surfaces of jacket 70, which includes two spaced-apart and generally parallel major surfaces 72 with two additional spaced-apart and generally parallel minor surfaces 74 extending between opposite sides of the major surfaces 72. As also shown, the intersections between the major surfaces 72 and minor surfaces 71 can be radiused to aide in manufacture and for aesthetic purposes. In an example, the above-described "flat" configuration can be achieved by configuring cable body 12 such that a cross-section thereof, taken along a plane that extends perpendicular to major surfaces 72 and minor surfaces 74 has a width 76 that is at least twice the height 78 thereof. In a particular example, the width to height ratio can be 2.5:1 or greater. In a further example, the width 76 can be about 6 mm (+/−0.2 mm) and the height 78 can be about 2.4 mm (+/−0.2 mm).

As shown in the cross-sectional view of FIG. 3 as well as the cutaway view of FIG. 2, the major surfaces 72 can extend through almost the entire width 76 of the cable body (e.g. through at least about 90% thereof) with the remainder of the width being defined by the radiuses 80 on either side of the major surfaces 72. In addition to the flat appearance given by the relatively wide cross-section of cable body 12, the major surfaces 72 themselves can be substantially flat throughout both the length 82 and width 76 of cable body 12. The flatness of the major surfaces 72 (and of cable body 12 in general) is described herein with respect to a reference configuration of cable body 12. In this reference configuration, cable body 12 is fully extended such that the longitudinal axis of cable body 12 is positioned along a straight line and such that cable body 12 is not twisted. It is to be understood, however, that cable body 12 is flexible and supple such that it is easily bent between various other configurations without retaining those configurations absent an external force. Cable body 12 can, as such, drape under its own weight over edges, between surfaces, or the like. Cable body 12 can also twist either under its own weight, under certain conditions, or under the application of torsional force thereto. In such other, non-reference, configurations, cable body 12 can still retain the general appearance of a flat cable. For example, the flat cross-section depicted in FIG. 2 can still be apparent throughout the length of cable body 12 regardless of the actual configuration or positions thereof.

One aspect of the flatness of the major surfaces 72 is a lack of sink lines overlying the areas in which the wires 40 and 60 extend through jacket 70. Similarly, major surfaces 72 can lack any dips or concavity between the locations of the wires 40 and 60. In some applications, flatness of a surface can be such that the cross section of the cable body 12 appears generally flat to the naked eye, or such that the major surfaces 72 appear to extend along a generally straight line between minor surfaces 74 without visible deviations to the naked eye at a distance of approximately an arm's length.

The composition of jacket 70 as well as the positioning and construction of the wires 40 and 60 extending therethrough can contribute to the flatness characteristics of cable body 12 as well as the overall flexibility and feel of cable body 12. In one example, the jacket 70 can be a generally solid unit that extends in cross section (as shown in FIG. 2) between the outer periphery thereof and the individual surfaces of the wires 40 and 60 that are internal to the jacket 70. In an example, at least 80% of the cross sectional area of cable body 12 (as depicted schematically in FIG. 3) can be occupied by jacket 70, with the remaining cross-sectional area being occupied by the internal wires 40 and 60 (including individual components thereof as well as any empty space therein). In a further example, about 90% (+/−2%) of the cross-sectional area of cable body 12 can be occupied by jacket 70. In such examples, the material of jacket 70 can continuously occupy such an area (with an allowance for any porosity of the material) with the material extending generally solidly therethrough. Jacket 70 can be made from Thermoplastic Elastomer ("TPE") or the like and can include a predetermined amount of silicone therein to improve the flexibility and tactile quality thereof. In an example, the jacket 70 can be a composite including TPE and between 0.01% and 5% silicone (by weight of the entire composite). In another example, the composite can include between 0.01% and 0.1% silicone. In yet another example, the composite can include between 1% and 3% silicone, or between 0.5% and 2% silicone.

Because the jacket 70 occupies all or nearly all of the cross-sectional area between wires 40 and 60 and the outer periphery of cable body 12, there is no separate insulation material between jacket 17 and the wires 40 and 60 (although the material of jacket 70 can itself provide a level of insulation). Accordingly, any insulation and/or shielding required for wires 40 and 60 can be internal to the wires themselves. In the example shown in FIGS. 2 and 3, the innermost wires (i.e. the wires closes to the vertical axis 18 of cable body 12) can be signal wires 40 that are configured to carry electronic signals between components to which the cable 10 is connected. To prevent the signal wires 40 from either receiving or transmitting interference to other components not connected with cable 10 and to prevent signal loss or degradation, the signal wires can include internal insulation 44 that surrounds the conductive core 42 of the wires 40. The conductive core can be made of a plurality of individual filaments of a conductive material, such as copper or the like. Such filaments can be twisted or otherwise gathered to collective form the core 42 that is generally circular in cross-section. The insulation 42 can also be generally circular in cross-section and can be made of a flexible dielectric material such as a polymeric or plastic material. The insulation 44 can also be comprised of filaments or other non-continuous elements of the insulation material or of fibrous material such as aramid fiber. Additionally, the signal wires 40 can include a layer of shielding 46 over the insulation layer 42 that can be of a conductive material, such as copper, aluminum, or the like. The shielding layer 46 can be woven or braided from filaments of the conductive material and can further prevent interference by or with the signal being carried. An insulating sheath 48 can cover the shielding material and can define the outer periphery of the signal wires 40. The sheath can be of a flexible dielectric material such as high-density polyethylene ("HDPE").

The outermost wires (i.e., those positioned closest the minor surfaces 74 of jacket 70) can be configured to carry power between devices connected with cable 10, which may mean that less shielding from or against signal interference is needed compared to signal wires 40. Such power wires 60 can be enameled wires having a conductive core 62 and an enamel insulating layer 64. As with the signal wires 40, the core 62 of the power wires 60 can comprise a plurality of filaments of a conductive material, such as copper or the like, that are twisted or otherwise gathered to define a generally circular cross section. The insulating layer 64 can be an enamel material, such as epoxy or urethane resin or the like, or other compounds including these materials in a mixture with other suitable materials. The insulating layer 64 or an enamel material can be formed as a coating over core 62 with the enamel material in a liquid state such that it cures into solid form over the core 62. In such a construction, the enamel material can be in more consistent contact at least with the outermost filaments of the core 62. In some applications, portions of the enamel material can extend and fill spaces between such filaments or otherwise intersperse within some of the filaments of the core 62 to provide a more unitary structure compared with wire structures (such as those used for signal wires 40) that employ a separately-formed insulating sheath. Accordingly, the use of enameled wire for the power wires 60 can contribute to a more flexible overall construction for cable body 12 and can reduce the appearance of sink lines in the major surfaces 72 because of the reduced empty space within the wires 60.

Again, the positioning of the wires 40 and 60 within jacket 70, as well as the proportions of the wires themselves between each other and with respect to jacket 70 can contribute to the flatness of major surfaces 72 and the overall flexibility and feel of cable body 12. Referring to FIG. 3, the signal wires can have an outside diameter of about 0.8 mm (+/−5%). Compared with the dimensions of jacket 70 given in the example above, an example of jacket can have a height 78 that is at least 2.5 times the diameter of the signal wires 40. In the particular dimensions discussed herein with respect to signal wires 40, an example of a corresponding jacket can have a material thickness that is at least 0.7 mm (+/−10%) in an area overlying the signal wires 40. The power wires 60 can have an outside diameter of, for example, 0.5 mm (+/−5%). Accordingly, in an example of cable body 12, the jacket can have a thickness 78 of at least 4.8 times that of the power wires 60.

In an example of cable body 12, as further shown in FIG. 3, the signal wires 60 can both be positioned along the horizontal lateral axis 16 of cable body 12 and can further be positioned adjacent each other on opposite sides of the vertical lateral axis 18 of cable body 12. In some applications, the signal wires 60 can be in contact with each other at least along various points throughout the length of cable body 12. Because of the construction of cable body 12 itself, there may be variations in the actual relative positioning between signal wires 60. For example, there may be portions where the wires are separated by a thin portion of jacket 70. Further, signal wires 60 may actually slightly cross the vertical axis 18 at various points along the length of cable body 12. In another example, the signal wires 60 may be intentionally separated at a distance therebetween such that they are consistently separated by a portion of jacket 70. Such a distance can be less than 0.1 mm, for example.

In such an example, power wires 60 can also be positioned on horizontal axis 16 on opposite sides of the vertical axis 18. Further, power wires 60 can be remote from the vertical axis 18 and remote from the signal wires 40. In the example shown in FIGS. 2 and 3, the power wires 60 can be positioned at a distance 66 from a respective signal wire 40 that is positioned on the same side of vertical axis 18. The power wires 60 can also be positioned at a distance 68 from a respective one of the minor surfaces 74 of jacket 70 that is also on the same side of vertical axis 18. In an example, the distances 64 and 66 can be approximately equal or within about 25% of each other. The distances 64 and 66 can also each be at least about 75% of the outside diameter of the power wires 60 themselves.

Figure 4:
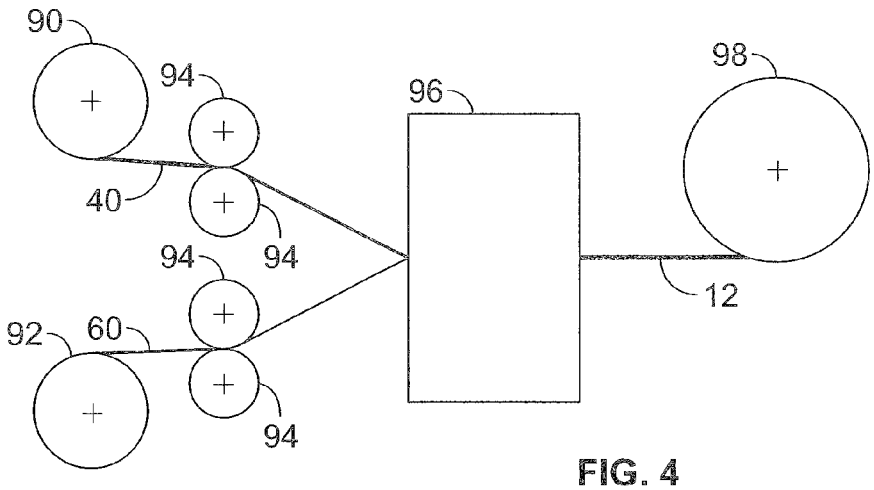
FIG. 4 shows a schematic view of various components that can be used in a method for making a cable body according to another aspect of the disclosure.

A method for making the cable body 12 according to another aspect of the present disclosure is discussed with respect to FIG. 4. Such a method can further contribute to the flatness of major surfaces 72, including a reduction in the appearance of sink lines or other visible interruptions in the flatness of the surfaces 72 associated with wires 40 and 60. As shown in FIG. 4 specialized machinery can be used to form jacket 70 over the signal wires 40 and the power wires 60 by an extrusion process. This can be done to achieve the solid cross-sectional profile of jacket 70 between the areas adjacent to and surrounding the wires 40 and 60 and the outer profile of cable body 12. This can be done by providing separate supplies of each of the wires used in a particular cable body configuration. In an example for manufacturing cable similar to those shown in FIGS. 2 and 3, two signal wire supplies 90 can be provided for each of the signal wires 40 to be included in a cable body 12. Similarly, two power wire supplies 92 can be provided for each of the power wires 60. The method can include drawing the signal wires 40 and the power wires 60 from the corresponding sources 90 and 92 (steps 100 and 102 in FIG. 5). The drawn portion of the signal wires 40 and power wires 60 can then be fed through rollers 94 and then through an extruder 96 in which heated TPE is brought into contact with the wires 40 and 60 and shaped into the desired profile of jacket 70, such as discussed above (step 108 in FIG. 5). The cable body 12 then emerges from the extruder 96 where it is drawn out to an appropriate length for cooling of the TPE for jacket 70 before being collected in a supply 98 of the bulk cable body 12.

Due to the solid configuration of jacket 70, as discussed above, the material thickness of jacket 70 may be uneven through the cross-section of cable body 12. In particular, the areas of jacket 70 between signal wires 40 and major surfaces 70 may be substantially thinner than other portions of jacket. Because of the nature of extrusion processes, wherein the material used for jacket 70 is provided in a heated state, cooling of the extruded material is required. Polymeric materials, including TPE, exhibit some material shrink during such cooling. This material shrink is proportionate to the volume of the material that is cooling. Because this volume is dependent on material thickness, the thicker portions will shrink more than thinner portions. The shrinking of the thicker portions (e.g. between the power wires 60 and the signal wires 40) can pull on the areas overlying the wires 40 and 60, causing stressing and, accordingly, further thinning of these areas. This stressing and thinning could potentially be a cause of sink marks in the areas of the major surfaces 72 adjacent the wires 40 and 60.

To compensate for any thinning of the portions of jacket 70 between the wires 40 and 60 and major surfaces 72, wires 40 and 60 can be compressed in the direction of vertical axis 18 (FIG. 3) prior to the extrusion step 108. As shown in FIG. 4, a plurality of rollers 94 can be provided in opposed pairs that the signal wires 40 and the power wires 60 can be respectively passed through to compress the wires in the desired direction (steps 104 and 106 in FIG. 5) prior to the extrusion step 108. The compression step can be configured to correspond to the amount of thinning or sinking expected in major surfaces 72 and can further be configured to only temporarily deform the wires 40 and 60. Accordingly, the wires 40 and 60 can remain compressed during extruding of jacket 70 thereover and during at least the initial cooling of the jacket material. During or after such cooling, the wires and 60 can return to their original shape, which will involve expansion in the direction of vertical axis 18. This expansion can push outward any areas of sinking produced in major surfaces 72 returning them to an acceptably flat configuration.

Figure 5:
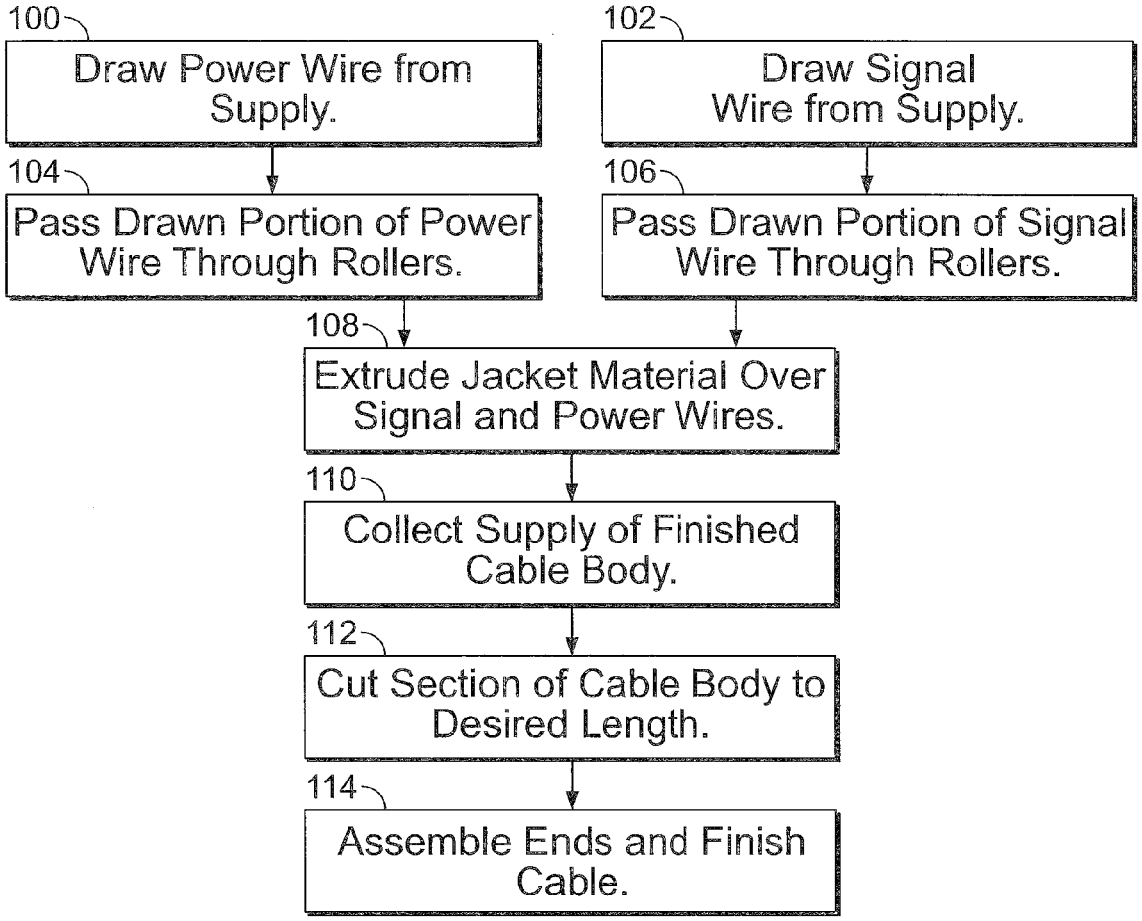
FIG. 5 shows a flow diagram of a method for making a connection cable, including steps carried out by the components depicted in FIG. 4.

After the bulk cable body 12 is collected it can be further processed by drawing a desired length off of the bulk supply 98 and cutting the cable body 12 to expose the cores 42 and 62 of the wires 40 and 60 (step 112 in FIG. 5). The connections 22 and 32 can then be joined with the wires 40 and 60 and housings 24 and 34 assembled over portions of the wires 40 and 60 and the connections 22 and 32 to finish the cable assembly 10 (step 114 in FIG. 5). Other finishing steps can be included, depending on the particular requirements of cable assembly 10 and the particular configurations of ends 20 and 30.

Although the description herein has been made with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A connection cable, comprising:

a generally flexible jacket extending along a length thereof and along first and second lateral axes perpendicular to the length thereof and defining substantially flat first and second major surfaces generally parallel to each other and spaced apart on opposite sides of the first lateral axis;

first and second inner wire assemblies extending within the jacket, each of the inner wire assemblies including a wire comprised of a plurality of conductive filaments, a shielding layer surrounding the wire, and an outer insulating layer surrounding the shielding layer and spaced apart from the wire, the jacket maintaining the first and second inner wire assembles in predetermined positions along the first lateral axis in within about 0.05 mm of each other and disposed on opposing sides of the second lateral axis, the first and second inner wire assemblies being in contact with each other at least along various points throughout the length of the flexible jacket; and first and second outer wire assemblies further extending within the jacket, each of the outer wire assemblies including a wire comprised of a plurality of conductive filaments and an insulating layer consisting essentially of an enamel material surrounding the wire, the jacket maintaining the first and second outer wire assemblies in predetermined positions along the first lateral axis on opposite sides of the second lateral axis and spaced apart from respective adjacent ones of the first and second inner wire assemblies.

2. The connection cable of claim 1, wherein the enamel material fills spaces between some of the conductive filaments of the outer wire assemblies.

3. The connection cable of claim 1, wherein the jacket defines a generally rectangular outer profile in a cross-section along a theoretical plane defined by the first and second lateral axes.

4. The connection cable of claim 3, wherein the jacket further defines first and second minor surfaces, each extending between the first and second major surfaces on respective opposite sides of the second lateral axis, the major surfaces and minor surfaces defining respective portions of the boundary along intersections thereof with the theoretical plane.

5. The connection cable of claim 3, wherein the jacket continuously fills the cross section in areas within the profile and outside of the inner and outer wire assemblies.

6. The connection cable of claim 1, wherein the first and second outer wire assemblies are in respective positions that are equidistant from respective outer edges of the jacket and from adjacent outermost portions of inner wire assemblies.

7. The connection cable of claim 6, wherein the first and second outer wires assemblies are separated from respective closest inner wire assemblies by respective distances of at least 0.5 mm.

8. The connection cable of claim 1, wherein the first and second major surfaces are spaced apart from respective closest portions of the inner wire assemblies at respective distances of at least 0.5 mm.

9. The connection cable of claim 8, wherein the inner wire assemblies each have diameters that are substantially equal to each other, and wherein the respective distances between the major surfaces and the inner wires assemblies are equal to the inner wire assembly diameters +/−10%.

10. The connection cable of claim 1, further including first and second substantially rigid connection elements respectively positioned on opposing ends of the cable jacket, and wherein the cable is generally flexible between the connection elements.

11. The connection cable of claim 1, wherein the jacket is an extruded composite material including thermoplastic elastomer and silicone.

12. The connection cable of claim 1, wherein the inner wire assemblies each include respective inner insulator layers inside the shielding layers thereof.

13. The connection cable of claim 1, wherein the enamel material is a cured epoxy resin.

14. The connection cable of claim 1, wherein the shielding layer and outer insulating layer comprise discrete layers surrounding each individual wire, such that the shielding layer and outer insulating layers each include a circular cross-section.

15. A connection cable, comprising:

a generally flexible jacket extending along a length thereof and along first and second lateral axes perpendicular to the length thereof, the jacket defining substantially flat first and second major surfaces generally parallel to each other and spaced apart opposite sides of the first lateral axis, and first and second minor surfaces extending between the first and second major surfaces; and first and second power wire assemblies extending within the jacket, each of the power wire assemblies including an outermost diameter, a wire comprised of a plurality of conductive filaments, and an insulating layer consisting essentially of an enamel material surrounding the wire and filling spaces between some of the conductive filaments thereof, the jacket maintaining the first and second power wire assemblies in predetermined positions along the first lateral axis, wherein the distance between the outermost diameter of the power wire and the closest minor surface of the flexible jacket is at least about 75 percent of a length of the outside diameter of the power wires.

16. The connection cable of claim 15, further including:

first and second signal wire assemblies extending within the jacket, each of the signal wire assemblies including a wire comprised of a plurality of conductive filaments, a shielding layer surrounding the wire, and an outer insulating layer surrounding the shielding layer and spaced apart from the wire;

wherein the jacket maintains the first and second signal wire assembles in predetermined positions along the first lateral axis in contact each other and disposed on opposing sides of the second lateral axis, and wherein the predetermined positions of the first and second power wire assemblies are spaced apart from the first and second signal wire assemblies on respective opposite sides of the second lateral axis.

17. The connection cable of claim 15, further comprising:

first and second inner wire assemblies extending within the jacket, each of the inner wire assemblies including a wire comprised of a plurality of conductive filaments, a shielding layer surrounding the wire, and an outer insulating layer surrounding the shielding layer and spaced apart from the wire, the jacket maintaining the first and second inner wire assembles in predetermined positions along the first lateral axis in within about 0.05 mm of each other and disposed on opposing sides of the second lateral axis, wherein the first and second power wire assemblies are respectively positioned adjacent the first and second minor surfaces, and the first and second inner wire assemblies are positioned between the first and second power wire assemblies.

18. The connection cable of claim 17, wherein the first and second power wire assemblies are in respective positions that are equidistant from respective minor surfaces of the jacket and from adjacent outermost portions of the first and second signal wire assemblies.

19. The connection cable of claim 16, wherein the jacket defines a generally rectangular outer profile in a cross-section along a theoretical plane defined by the first and second lateral axes.

20. The connection cable of claim 15, wherein each of the first and second minor surface extend between the first and second major surfaces on respective opposite sides of the second lateral axis, the major surfaces and minor surfaces defining respective portions of the boundary along intersections thereof with the theoretical plane.

* * * * *